United States Patent [19]

Frazier et al.

[11] Patent Number: 4,711,282

[45] Date of Patent: Dec. 8, 1987

[54] PORTABLE AND COLLAPSIBLE STAIR

[76] Inventors: Stanley J. Frazier, 1523 125th Ave. SE., Bellevue, Wash. 98005; Blaine Sorenson, 18813 SE. Lake Holm Rd., Auburn, Wash. 98002

[21] Appl. No.: 871,716

[22] Filed: Jun. 6, 1986

[51] Int. Cl.[4] ..... E06C 1/383

[52] U.S. Cl. ..... 182/106; 182/156

[58] Field of Search ..... 182/106, 156, 165, 125, 182/126; 108/119; 297/53, 125

[56] References Cited

U.S. PATENT DOCUMENTS

| | | | |
|---|---|---|---|
| 362,379 | 5/1887 | Henry | 108/119 |
| 1,222,673 | 4/1917 | Rizzo | 297/125 |
| 1,406,888 | 2/1922 | Pandolfo | 297/53 |
| 2,217,658 | 10/1940 | Puy | 108/119 |
| 2,643,925 | 6/1953 | Derman | 108/119 |
| 2,871,075 | 1/1959 | Stone | 108/119 |
| 3,058,544 | 10/1962 | Rossi | 182/156 |
| 3,166,028 | 1/1965 | Zagel | 108/119 |
| 3,547,225 | 12/1970 | Deane | 182/148 |
| 3,999,629 | 12/1976 | Schaffer | 182/156 |
| 4,425,984 | 1/1984 | Lachance | 182/106 |

FOREIGN PATENT DOCUMENTS

| | | | |
|---|---|---|---|
| 1171890 | 10/1958 | France | 182/156 |
| 1265972 | 5/1961 | France | 182/125 |

*Primary Examiner*—Reinaldo P. Machado
*Attorney, Agent, or Firm*—Hughes & Cassidy

[57] ABSTRACT

A portable and collapsible stair which provides support platforms that are spaced laterally and vertically from one another at approximately a one-to-one slope, thus enabling a person to ascend or descend the stair in a more convenient walking motion. There are two inverted U-shaped cross members pivotally connected to one another at a pivot axis intermediate the ends of the legs of the two U-shaped members. An upper support platform extends between the upper ends of the two inverted U-shaped members. There are one or more additional support platforms extending horizontally from forwardly positioned lower leg portions of one of the U-shaped members.

17 Claims, 12 Drawing Figures

90
88
86
84
82
10
36
24
18
16
38
32
50
28
62
40
70
72
64
68
108
14
103
26
30
34
78
74
12
80
66
16
76
20

86
88
90
92
94
82
84
3
36
18
32
24
28
50
62
c
d
10
38
70
68
64
74
78
14
110
108
42
54
40
48
46
80
16
12
44
66
76
20
102
22
a
106
104
103
26
30
34
b

PORTABLE AND COLLAPSIBLE STAIR

BACKGROUND OF THE INVENTION

1. Technical Field

The present invention relates to a portable and collapsible stair, and more particularly, to such a stair which particularly lends itself to a more convenient upward and downward walking motion.

2. Background Art

There are various occasions where a person must walk from one level to another while carrying various objects. A typical situation is where a boat is alongside a dock, and the upper edge of the side wall of the boat is positioned above the dock level. Quite often, a person boarding the boat will be carrying various supplies. Conventional stepladders are generally rather difficult to use in these situations, one of the reasons being that the lateral spacing of the support platforms or rungs is not great enough to permit a more normal upward walking motion.

A further consideration is that the ladder or stair must provide a broad and sturdy support structure when in its use position, and yet be able to be conveniently moved to its collapsed or stowage position, where the stepladder or stair is as compact as possible. Yet another consideration is the ladder or stair be structurally simple and constructed in the manner so that the manufacturing process can be accomplished economically.

A search of the patent literature has revealed a number of ladders, step stools, tables and the like. These are as follows.

U.S. Pat. No. 3,999,629—Schaffer et al illustrates a step stool where there are two main support members having vertical legs which cross one another. There is an upper support platform extending between upper ends of the legs, and a lower support platform extending between the legs below their pivot connecting location.

U.S. Pat. No. 3,166,028—Zagel shows a table which in general has the same overall configuration as the Schaffer et al patent discussed immediately above.

U.S. Pat. No. 3,058,544—Rossi et al shows a folding stool where there are two horizontal support platforms. One of the platforms is pivotally connected by its rear edge to the legs of one support member, and its forward end is supported from the upper ends of the legs of a second support member. There is a lower support platform having its rear edge portion connected to the legs of the second support member, and having its forward edge portion supported from the legs of the first support member.

U.S. Pat. No. 2,871,075—Stone shows a collapsible table having two inverted U-shaped support members. In the operating support position, upper cross members of the two support members support the platform which is the table.

U.S. Pat. No. 2,643,925—Derman shows a collapsible service table somewhat similar to that shown in the Stone patent discussed immediately above.

U.S. Pat. No. 2,217,658—De Puy shows a folding bath stand and dressing table for an infant. There are two support members, each having downwardly extending legs. There is an upper dressing table 9 positioned between the upper ends of the legs, and there is a lower support platform supported from one pair of legs, and positioned substantially directly below the upper dressing table.

U.S. Pat. No. 1,406,888—Pandolfo shows a collapsible chair having two pairs or crossed legs, with the seat of the chair extending between upper edges of the legs.

U.S. Pat. No. 1,222,673—Rizzo shows what is called a "convertible chair". When functioning as a chair, there are two first support legs which extend upwardly and rearwardly and two second support legs which extend upwardly and forwardly, with the two pair of legs being pivotally connected at intermediate locations. The chair platform has its rear edge pivotally connected to the first set of legs below the pivot connection and extends forwardly therefrom. There is a support member pivotally connected to a lower end portion of the first legs and extending upwardly and forwardly to support the chair platform. There is an upper movable panel 28 that is gripped between two laterally spaced blocks 27. In the chair configuration and in the stowed configuration, this panel 28 extends upwardly from the upper end portions of the first legs. In FIG. 7, the convertible chair is shown in a stepladder configuration where the panel 28 is supported from the upper ends of the two pairs of legs.

U.S. Pat. No. 362,379—Henry shows a folding stool where there is a support platform supported from the upper ends of two pairs of crossed legs.

SUMMARY OF THE INVENTION

It is an object of the present invention to provide a structurally simple and yet sturdy portable and collapsible stair which can conveniently be moved between a stowed position and an operating position, with the stair in its operating position having a plurality of horizontal support platforms having sufficient lateral spacing so as to enable the person to ascend or descend the steps or platforms in a more convenient walking motion. It is a further object to provide such a portable and collapsible stair that is compact and conveniently handled in its stowed position There are first and second inverted U-shaped support members, having first and second laterally spaced legs, respectively, each having an upper end and a lower end, and also having first and second cross members, respectively, interconnecting the upper ends of the related legs. The first legs are pivotally connected to the second legs about a first pivot axis located between the ends of the legs. The first and second U-shaped members have a stowed position where each of the first legs is adjacent to, and generally parallel to, an adjacent one of the second legs. Ihey also have an operating position where the first legs are crossed with the second legs at an angle, with the first and second cross members being spaced from one another and lying in a common, generally horizontal plane, and the lower ends of the first legs being positioned forwardly of the lower ends of the second legs.

There is a first upper support platform that has a rear edge portion hinge connected to the first cross member at a second pivot axis. This first platform is movable between a stowed position, where the upper platform extends downwardly from the first cross member so as to be adjacent to and parallel to the first legs, and a horizontal support position where a forward edge portion of the first platform is supported by the second cross member.

There is a third inverted U-shaped member comprising two legs having lower ends pivotally connected to the first legs at a third pivot axis positioned below the first pivot axis. This third U-shaped member has a third cross member connected to and extending between upper ends of the third legs. The third U-shaped member has a stowed position where the third legs are positioned adjacent to, and parallel to, the first legs, and a support position where the third legs extend from the third pivot axis upwardly and forwardly away from the first legs.

There is a second lower support platform having a rear edge portion pivotally mounted to and positioned between the first legs at a fourth pivot axis located between the upper and lower ends of the first legs. This second platform is movable between a stowed position, where the lower platform extends downwardly from the fourth pivot axis so as to be adjacent to and parallel to the first legs, and a horizontal support position where a front edge portion of the second platform is supported from the third inverted U-shaped member at its support position.

In the preferred form, the upper platform has mounting member means connected thereto. This mounting member means defines elongate slot means having a substantial lengthwise alignment component generally parallel to a plane occupied by the upper platform. The second cross member of the second U-shaped inverted member is positioned in the slot means in a manner to be movable from a rear end of the slot means, at which the second cross member is positioned when the first upper platform is in a stowed position, to a second forward end of the slot means at which the second cross member is positioned when the first upper platform is in its horizontal position. Desirably, the mounting member means comprises two mounting members connected to the first upper platform at laterally spaced locations, with the slot means comprising an elongate slot in each of the mounting members.

Also, in the preferred form, at least one of the slots has at a forward end thereof and at a rear end thereof a reduced width portion at which the second cross member can be yieldingly held so that the second cross member can be releasably retained at end locations of the slot of the mounting member.

In the preferred configuration, the distance from a portion of the second cross member located in the slots to the first pivot axis is less than a distance between the first pivot axis and the second pivot axis. Thus, when the first upper platform moves from the support position to the stowed position, the first upper platform rotates about the second pivot axis downwardly toward the first pivot axis.

Also, in the preferred form, the second platform has mounting means arranged similarly to the mounting means that is connected to the first platform. Also, in one embodiment, there is additionally a third intermediate platform mounted and arranged similarly to the second lower platform.

Also, in the preferred embodiment, there is a hand rail assembly comprising first and second posts and a hand rail member interconnecting with the upper ends of the first and second posts. The posts each have at their lower ends a laterally extending mounting member adapted to fit removably into a related receiving recess in the stair, thereby permitting the first and second post to be removably mounted to the stair.

In a specific configuration, the first cross member of the first U-shaped member has one end thereof defining the recess for the laterally extending mounting member of the first post. The stair also comprises a third cross member connected to and extending between the first legs at the fourth pivot axis. This third cross member has an open end portion defining the recess to receive the laterally extending mounting member of the second post.

As a further specific feature, the posts and the hand rail member are releasably connected to one another. Further, the stair comprises a fourth cross member connected to and extending between the second legs. This fourth cross member defines a plurality of yielding mounting recesses to releasably engage and hold the posts and the hand rail member in a stowed position against the stair.

In the preferred form, with the first and second U-shaped members in the operating position, the first legs make a first angle with a support plane that is defined by the first lower ends of the first legs and the second lower support ends of the second legs, while the second legs make a second angle with the support plane. The first angle is less than the second angle. Desirably, the first angle is between about 35° to 55° and the second angle is between about 55° to 75°. More specifically, the first angle is about 45°, and the second angle is about 65°.

Other features will become apparent with the following detailed description.

DESCRIPTION OF THE PREFERRED EMBODIMENTS

Figures 1, 2:
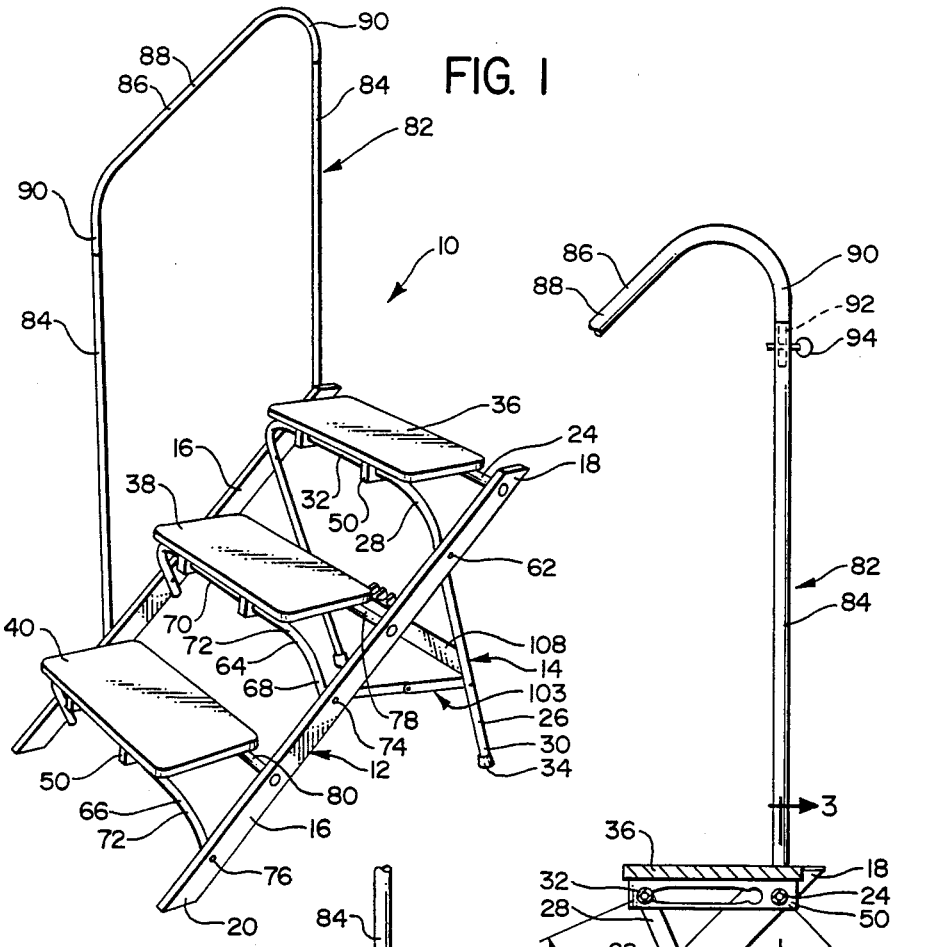
FIG. 1 is an isometric view of a first embodiment of the stair of the present invention in its expanded, operating position.
FIG. 2 is a sectional view taken along a vertical plane that extends through the middle of the stair in a rearward to forward direction.

With reference to FIGS. 1–8, the stair 10 of the first embodiment comprises two inverted U-shaped members 12 and 14, respectively. The first U-shaped member 12 comprises two legs 16, each having upper and lower ends 18 and 20, respectively. The lower ends 20 each have a horizontal ground engaging pad 22 (the term "ground" being used in its broader sense to denote an underlying support surface, such as a floor, a boat dock, a natural earth surface, etc.), and the upper ends 18 are rigidly interconnected by a tubular cross member 24 having a generally circular cross section. In this particular embodiment, the two legs 16 each have a generally rectangular cross section.

The second inverted U-shaped member 14 is conveniently made from a single piece of cylindrical tubing which is formed into the "U" shape. This member 14 comprises two legs 26 having upper and lower end portions 28 and 30, respectively, with the upper end portions 28 being bent in a right angle curve to join to a cross member 32. The lower end 30 of the legs 26 have a suitable ground engaging padded member 34.

In this particular embodiment, there are three platforms, namely an upper platform 36, an intermediate platform 38 and a lower platform 40. These three platforms 36–40 are or may be substantially identical to one another. Each platform 36–40 has a generally rectangular plate-like configuration having an upper surface 42, a lower surface 44, a rear edge portion 46, and a forward edge portion 48. The upper surface 42 is provided as a non-skid tread surface. Each platform 36–40 has fixedly attached to its lower surface 44 a pair of laterally spaced longitudinally extending mounting members 50, with one of the mounting members of the top platform 36 being illustrated in more detail in FIG. 8. Each mounting member has a rear circular through opening 52 by which the platform 36–40 is swing mounted or hinge mounted. Further, each mounting member 50 has an elongate longitudinally extending slot 54. Each slot has its forward and rear end portions circularly curved as at 56 and 58, and each curved end portion 56 and 58 has a slight protrusion or inwardly extending neck portion 60 at the locations where the end portions 56 and 58 join to the slot 54.

Figure 8:
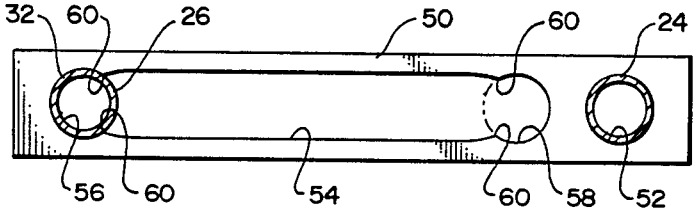
FIG. 8 is an enlarged view to illustrate the configuration of one of the mounting slots in a mounting member of one of the support platforms.

As further illustrated in FIG. 8, the upper platform 36 is swing mounted to the cross member 24 of the first U-shaped member 12, with the cross member 24 defining the pivot axis of the platform 36, and with the cross member 24 extending through the rear openings 52 of the two mounting members 50. The cross member 24 has a moderately snug fit in the openings 52 so that the platform 36 is firmly mounted to the cross member 24, but yet can be rotated or swung about the cross member 24 without a substantial amount of effort.

The cross member 32 of the second U-shaped member 14 fits slideably in the slots 54 of the two mounting members 50 of the upper platform 36. The distance between each set of protrusions or neck portions 60 is just slightly less than the diameter of the cross member 32 so that the cross member 32 can be snapped into place at each of the end locations 56 and 58 of each slot 54.

The two legs 26 of the U-shaped member 14 are positioned just inside of the two legs 16 of the U-shaped member 12. Each leg 26 is pivotally connected at 62 to an adjacent one of the legs 16. The two pivot connections 62 define a pivot axis for the U-shaped members 14 and 16, and each pivot connection 62 is spaced a moderate distance downwardly from the cross members 24 and 32 of the U-shaped members 12 and 14, respectively.

There are third and fourth inverted U-shaped members 64 and 66 to support the intermediate and lower platforms 38 and 40, respectively. Each U-shaped member 64 and 66 has a pair of legs 68 connected to a cross member 70. In a manner similar to the second U-shaped member 14, the two U-shaped members 64 and 66 are formed from a single tubular member, with the legs 68 joining to the cross member 70 by means of two rounded connecting portions 72. The legs 68 are much shorter than the legs 26 of the U-shaped member 14, and the lower end of each leg 68 is pivotally connected to a related one of the legs 16. The pivot connections of the third U-shaped member are indicated at 74, with these defining a pivot axis, while those of the fourth U-shaped member are indicated at 76, these also defining a pivot axis. The pivot connections 74 are at about the mid-length of the legs 16, while the pivot connections 76 are quite close to the lower ends 20 of the legs 16.

There are two additional cross members 78 and 80 which are the same as, or similar to, the cross member 24 and are fixedly connected to, and extend between, the legs 16. The cross member 78 is positioned a moderate distance upwardly from its related pivot locations 74, while the cross member 80 is positioned a moderate distance upwardly from its related pivot locations 76. The intermediate and lower platforms 38 and 40 are swing mounted at their rear edge portions to the second and third cross members 78 and 80, respectively, by these cross members 78 and 80 fitting into related through openings 52 of the mounting members 50 of the platforms 38 and 40. In like manner, the cross members 70 of each of the U-shaped members 64 and 66 fit in related slots 54 of the mounting members 50 of the intermediate and lower platforms 38 and 40, respectively.

There is a removable handrail 82, made up of three sections, namely two posts 84 and a connecting rail portion 86. The rail portion 86 has a main straight section 88 curved at the ends into short downwardly extending connecting portions 90. Each connecting portion 90 has a reduced diameter connector 92 (see FIG. 2) that fits within an open upper end of one of the posts 84. A threaded retaining member 94 (see FIG. 2) or some other suitable retaining device is used to secure the two end connecting portions 90 to the upper end of the posts 84.

Figure 3:
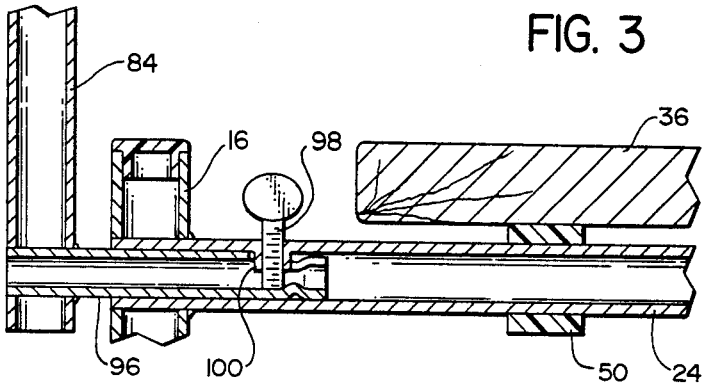
FIG. 3 is a sectional view taken along line 3—3 of FIG. 2 and illustrating a lower portion of a side rail in its attached position.
Figure 4:
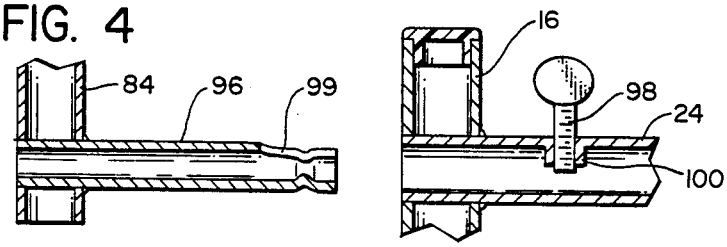
FIG. 4 is a view similar to FIG. 3, and illustrating the side rail portion in its non-attached position.
Figure 5:
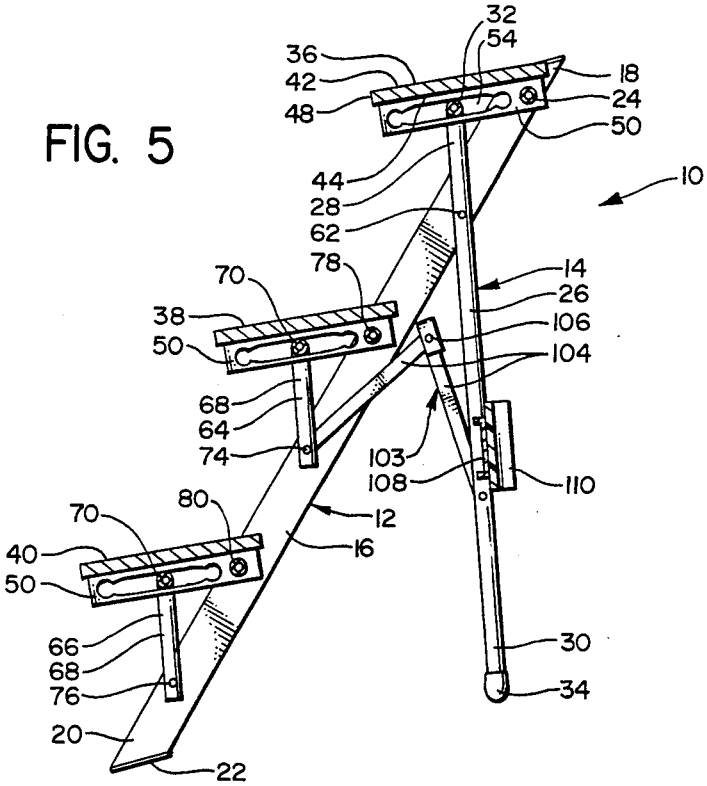
FIG. 5 is a view similar to FIG. 2, but showing the stair in an intermediate position between its fully extended operating position and its fully collapsed position.
Figure 6:
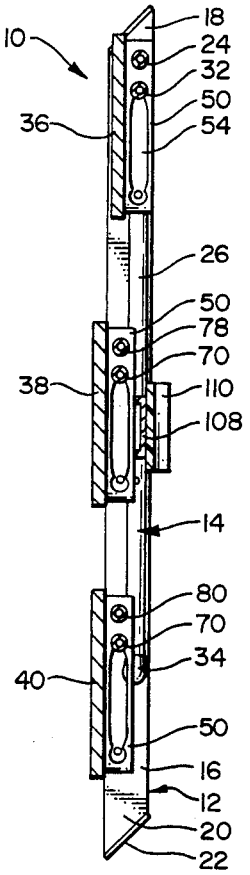
FIG. 6 is a view similar to FIGS. 2 and 5, but showing the stair in its fully collapsed position.

As illustrated in FIGS. 3 and 4, the lower end of each post 84 has fixedly connected thereto an inwardly extending tubular rod 96. One of these rods 96 fits in an open end of the connecting member 24, and the rod 96 of the other post fits in a similar manner into an open end of the lowermost cross member 80. Threaded retaining members 98 can be inserted through a threaded socket member 100 to secure a related positioning rod 96 in its cross member 24 or 80. Alternatively, a detent pin, passing all the way through the cross member 24 or 80, could be used in place of the threaded retaining member 98. FIG. 3 shows the rod 96 of one of the posts 94 in its secured position, while FIG. 4 shows the rod 96 in its disengaged position. The inner end of each rod 96 has its inner end portion cut away and deformed inwardly to a slight degree, as at 99, to receive the threaded member 98 in retaining engagement.

To describe the operation of the present invention, attention is first directed to FIG. 2 which shows the stair 10 in its fully expanded operating position. In this position, the two legs 16 extend upwardly and rearwardly from the underlying surface 102 at an angle "a"

of between about 35° to 55°, and desirably about 45° from the surface 102. The two rearwardly positioned legs 26 extend upwardly and forwardly from the underlying surface 102 at an angle "b" of between about 55° to 75°, and desirably about 65° from the surface 102. The legs 26 are moderately shorter than the legs 16 to enable these legs 16 and 26 to be so positioned. The lower ground engaging padded member 34 of the legs 26 is positioned moderately rearwardly of the rear edge portion 46 of the upper platform 28. The two U-shaped members 12 and 14 are maintained in the position of FIG. 2 by means of a pair of conventional retaining arms 103, each of which is pivotally connected between two of the legs 16 and 26, with each arm 103 having two arm sections 104 that pivot about an intermediate elbow joint 106.

It will be noted that in the position of FIG. 2, the cross member 32 of the U-shaped member 14 is at the most forward position in the related slots 54 of the mounting members 50 of the upper platform 36, with the upper platform 36 being horizontally aligned. Due to the retaining action of the forward neck portion 60 of each slot 54, the cross member 32 is releasably held at that forward position.

In the expanded or operating position of FIG. 2, the third and fourth U-shaped members 64 and 66 are each positioned in their more forward position, so that the cross members 70 are at the most forward location in the slot 54 of the mounting members 50 of the intermediate and lower platforms 38 and 40. In this position the two platforms 38 and 40 are horizontally aligned.

It will be noted that the length from the pivot location 62 to the center of the cross member 32 (indicated at "c" in FIG. 2) is slightly less than the distance between the pivot location 62 and the cross member 24 of the first U-shaped member 12. In like manner, the distances between the pivot locations 74 and 76 to the cross members 70 of the third and fourth U-shaped members 64 and 66, respectively, are moderately less than the distances from the pivot locations 74 and 76 to the cross members 78 and 80, respectively. Further, the alignment of the legs 26 and 68 is more nearly vertical than the alignment of the legs 16. Thus, in the position of FIG. 2, the three platforms 36, 38 and 40 are horizontally aligned. Further, as will be described more completely below, this geometry enables the platforms 36, 38 and 40 to be swung downwardly into a position generally parallel with the legs 16, and the U-shaped members 64 and 66 to be swung rearwardly, when the stair 10 is being moved to its collapsed position.

In the fully expanded operating position of FIGS. 1 and 2, the handrail 82 is in place, with the two posts 84 having their mounting rods 96 fixedly connected in the cross members 24 and 80, as illustrated in FIG. 3.

It will be noted that in the operating position of FIG. 2, the vertical spacing of the three platforms 36–40 is approximately the same as the lateral spacing of these platforms 36–40. Thus, the person is able to ascend or descend the stair with a more normal walking motion of going up or down stairs with the person on a line of about a one-to-one slope. Further, the rear end edges 46 of each platform 40 and 38 are vertically aligned with (or slightly forwardly of vertical alignment with) the front edges 48 of the platforms 38 and 36, respectively. The width dimension of each platform 36–40 is between about seven to ten inches, while the length dimension (i.e. the lateral dimension) is between about fifteen to twenty-one inches, and desirably about eighteen inches. Further, the vertical spacing of the platforms 36–40 is approximately equal to the vertical spacing of the platforms 36–40.

To move the stairr 10 to its collapsed position, the cross members 32 and 70 are snapped out of the forward portions 56 of the slots 54 and slid rearwardly in the slots 54. Also, the retaining arms 103 are articulated about their elbow joints 106 so that the arm sections 104 move together toward the collapsed position. As the lower ends 30 of the legs 26 are moved forwardly toward the lower ends 20 of the legs 16, the cross member 32 moves further rearwardly in the slots 54, and at the same time, the upper platform 36 moves downwardly. (See FIG. 5.) When the legs 26 have been moved fully within the legs 16 (so as to be adjacent and parallel thereto), the upper platform 36 is positioned adjacent and parallel to the two legs 16, with the platform 36 extending downwardly from the cross member 24.

In like manner, as the two sets of legs 68 of the third and fourth U-shaped members 64 and 66 are rotated rearwardly, the intermediate and lower platforms 38 and 40 swing downwardly about their respective cross members 78 and 80 so that these platforms 38 and 40 also come to be positioned adjacent to, and parallel to, the legs 16.

Figure 7:
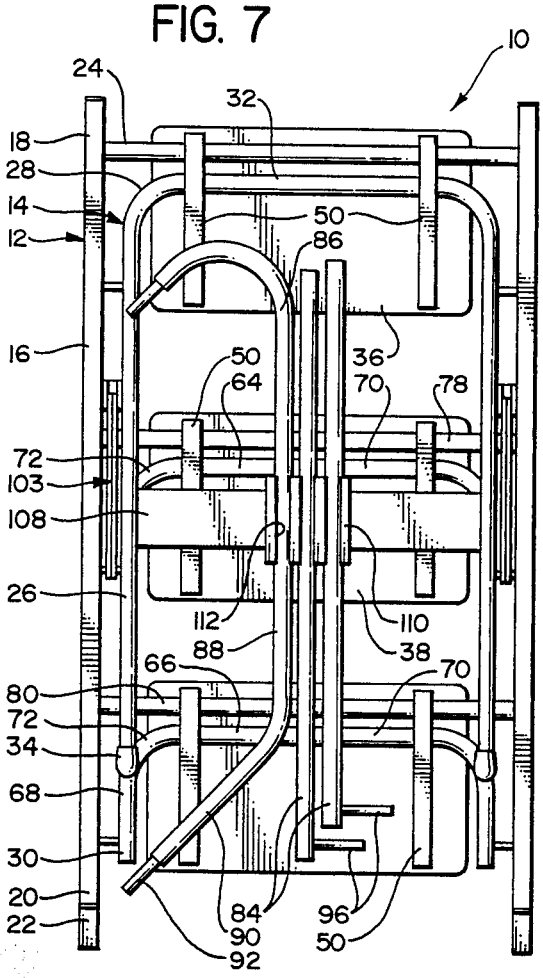
FIG. 7 is a rear elevational view of the stair in the stowed position of FIG. 6, with the side rail being dismantled and removably secured to a backside of the stair.

It will be noted that there is a crossbar 108 fixedly connected to and extending across the two legs 26 at approximately a middle location. This crossbar 108 has four moderately resilient retaining elements 110 (see FIG. 7) that define three vertical slots 112 that are sized to receive therein the two posts 84 and the rail portion 86 of the handrail 82. Thus, after the stair 10 has been moved to its collapsed position and the handrail 82 dismantled, the posts 84 and the rail portion 86 can be snapped into these retaining elements 110 for convenient storage. This arrangement is illustrated in FIG. 7.

The second embodiment of the present invention is illustrated in FIGS. 9 through 12. In describing this second embodiment, components which are similar to components of the first embodiment will be given like numerical designations, with an "a" suffix distinguishing those of the second embodiment.

The stair **10*a*** of this second embodiment is functionally substantially similar to that of the first embodiment, except that only two platforms are provided. Further, there are some specific structural differences.

The stair **10*a* of the present embodiment comprises two inverted U-shaped members 12*a* and 14*a*, respectively. In this second embodiment, the U-shaped member 12*a* is formed from a single tubular member so that the legs 16*a* have 90° curved upper end portions to join to the cross member 24*a*. The second U-shaped member 14*a* is formed in substantially the same manner as the U-shaped member 14 of the first embodiment. There is an upper platform 36*a*, pivotally mounted to the cross member 24*a*, and a lower platform 40*a*, pivotally mounted to a cross member 80*a*. There is a lower inverted U-shaped support member 66*a*. The pivot mounting of the inverted U-shaped member 66*a* is accomplished by means of a cross rod 120 extending between lower ends of the legs 16*a***.

The two platforms **40*a* and 36*a* each have laterally spaced and longitudinally extending mounting members 50*a*** which function in substantially the same manner as in the first embodiment.

Figure 9:
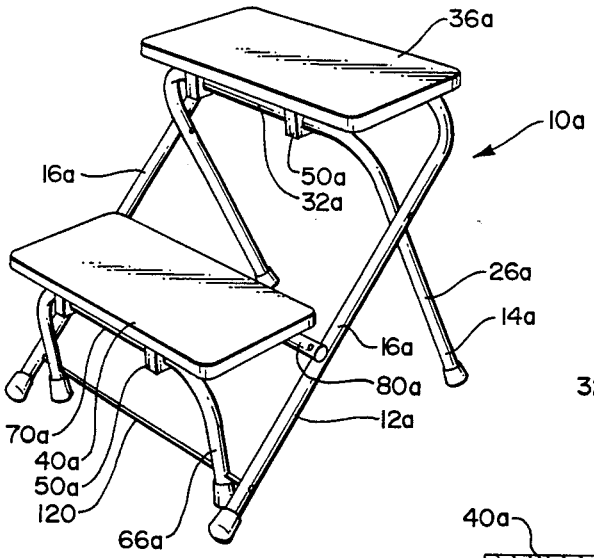
FIG. 9 is an isometric view of a second embodiment of the present invention having only two support platforms, with the stair being in its expanded operating position.
Figure 10:
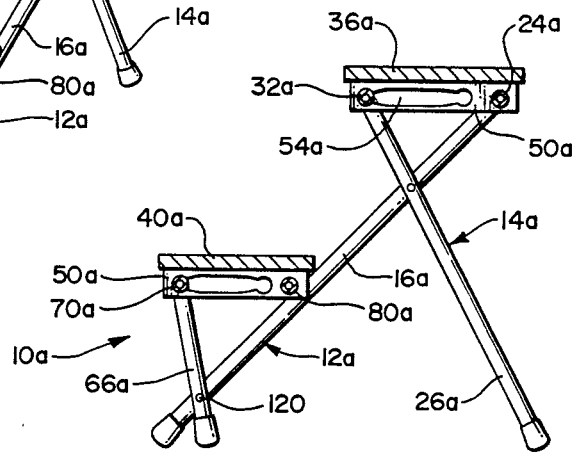
FIG. 10 is a sectional view of the stair of the second embodiment shown in FIG. 9, with this view being similar to that of FIG. 2.
Figure 11:
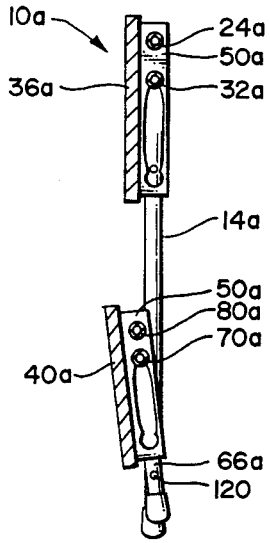
FIG. 11 is a view similar to FIG. 10, but showing the stair of the second embodiment in its fully collapsed position.
Figure 12:
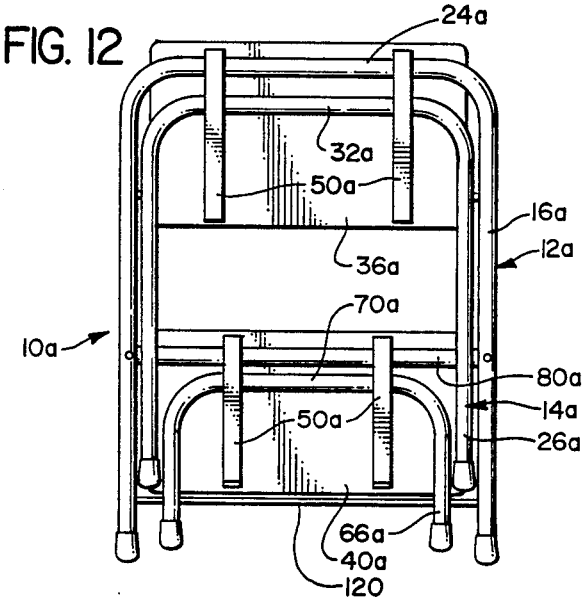
FIG. 12 is a rear elevational view of the stair of FIGS. 9–11 in its collapsed position for being stowed.

The overall geometrical relationships of this second embodiment **10*a* are substantially the same as in the first embodiment 10. Further, the mode of operation is substantially the same, in that the stair 10a is moved to its expanded position by extending the lower ends of the leqs 16a and 26a away from one another, and also by moving the lower U-shaped member 66a outwardly to its support position, as shown in FIGS. 9 and 10. In the extended position of FIGS. 9 and 10, the U-shaped members 12a and 14a are held in their expanded position by the engagement of the cross member 32a with the mounting members 50a at the forward ends of the slots 54a. The stair 10a** is collapsed in substantially the same manner as in the first embodiment.

Further, it should be recognized that more than three platforms could be provided while using the same basic construction of the stair of the present invention, and that other modifications could be made without departing from the teaching from the present invention.

What I claim as my invention is:

1. A collapsible stair comprising:

a. a first inverted U-shaped support member comprising two laterally spaced first legs, each having a first lower support end and a first upper end, and a first cross member interconnecting the first upper ends;

b. a second inverted U-shaped support member having two second legs, each having a second lower support end and a second upper end, and a second cross member interconnecting the second upper ends of the second legs, said first and second legs being pivotally connected to one another at a first pivot axis located between the upper and lower ends of the first and second legs;

c. said first and second U-shaped members having a collapsed position where each of said first legs is adjacent to, and generally parallel to, an adjacent one of said second legs, and an operating position where the first legs are crossed with the second legs at an angle, with the first and second cross members being spaced from one another and lying in a common generally horizontal plane, and the lower first ends being positioned forwardly of the lower second ends;

d. a first upper support platform having a rear edge portion hinge connected to said first cross member at a second pivot axis, and being movable between a first stowed position, where the upper platform extends downwardly from the first cross member so as to be djacent to, and generally parallel to, said first legs, and a second horizontal support position where a forward edge portion of the first platform is supported by said second cross member;

e. a third inverted U-shaped member comprising two third legs having lower ends pivotally connected to the first legs at a third pivot axis positioned below said first pivot axis, and a third cross member conneceed to and extending between upper ends of the third legs, said third U-shaped member having a third stowed position where the third legs are positioned adjacent to, and parallel to, the first legs, and a fourth support position where the third legs extend from the third pivot axis upwardly from the first legs;

f. a second lower support platform having a rear edge portion pivotally mounted to and positioned between said first legs at a fourth pivot axis located between the upper and lower ends of the first legs, and being movable between a fifth stowed position, where the lower plaform extends downwardly from said fourth pivot axis so as to be adjacent to, and parallel to, said first legs, and a sixth horizontal support position where a front edge portion of the second platform is supported from said third inverted U-shaped member in its support position;

g. said second lower platform having mounting member means connected thereto and defining an elongate slot means having a substantial lengthwise alignment component generally parallel to a plane occupied by said second lower platform, said third cross member of said third inverted U-shaped member being positioned in said slot means in a manner to be movable from a rear end of said slot means, at which said third cross member is positioned when the second lower platform is in its fifth stowed position, to a second forward end of said slot means at which said third cross member is positioned when the second lower platform is in its horizontal support position;

h. said stair being characterized in that a first distance between a portion of said third cross member located in said slot means to said third pivot axis is less than a distance between said third pivot axis and said fourth pivot axis, whereby when said second lower platform moves from said sixth support position to said fifth stowed position, said second lower platform rotates about said fourth pivot axis downwardly toward said third pivot axis; and i. said stair being further characterized in that with said third U-shaped member in said fourth support position, said third legs have a substantial vertical alignment component greater than any horizontal alignment component of the third legs, whereby said third legs are positioned to effectively carry compression loading vertically from said second platform.

2. The stair as recited in claim 1, wherein said mounting member means comprises two mounting members connected to the second lower platform at laterally spaced locations with said slot means comprising a slot in each of said mounting members.

3. The stair as recited in claim 2, wherein at least one of said slots has at a forward end thereof and at a rearward end thereof a reduced width section at which said third cross member can be yieldingly held so that said third cross member can be reIeasably retained at end locations of the slot of the mounting member.

4. The stair as recited in claim 1, wherein said upper platform has a second mounting member means connected thereto and defining second elongate slot means having a substantial lengthwise alignment component generally parallel to a plane occupied by said upper platform, said second cross member of said second inverted U-shaped member being positioned in said second slot means in a manner to be movable from a rear end of said second slot means, at which said second cross member is positioned when the first upper platform is in its first stowed position, to a second forward end of said second slot means at which said second cross member is positioned when the first upper platform is in its second horizontal support position.

5. The stair as recited in claim 4, wherein said second mounting member means comprises two second mounting members connected to the first upper platform at laterally spaced locations, with said second slot means comprising a second elongate slot in each of said second mounting members.

6. The stair as recited in claim 5, wherein at least one of said second slots has at a forward end thereof and at a rearward end thereof a reduced width section at which said second cross member can be yieldingly held so that said second cross member can be releasably retained at end locations of the second slot of one of the second mounting members.

7. The stair as recited in claim 5, wherein a first distance from a portion of said second cross member located in said second slots to said first pivot axis is less than a distance between said first pivot axis and said second pivot axis, whereby when said first upper platform moves from said second support position to said first stowed position, said first upper platform rotates about said second pivot axis downwardly toward said first pivot axis.

8. The stair as recited in claim 4, wherein a first distance from a poriton of said second cross member located in said second slot means to said first pivot axis is less than a distance between said first pivot axis and said second pivot axis, whereby when said first upper platform moves from said second support position to said first stowed position, said first upper platform rotates about said second pivot axis downwardly toward said first pivot axis.

9. The stair as recited in claim 1, further comprising a hand rail assembly comprising first and second posts having respective upper and lower ends, and a hand rail member having first and second end portions interconnecting with the upper ends of said first and second posts, respectively, each of said first and second posts having at their respective lower ends a laterally extending mounting member adapted to fit removably into a related receiving recess in said stair, whereby said first and second posts can be removably mounted to said stair.

10. The stair as recited in claim 9, wherein said first cross member has one end thereof defining said recess for the laterally extending mounting member of the first post, said stair further comprising a fourth cross member connected to and extending between said first legs at said fourth pivot axis, said fourth cross member having an open end portion defining the recess to receive the laterally exending mounting member of the second post.

11. The stair as recited in claim 10, wherein said first and second posts and said hand rail member are releasably connected to one another, whereby the first and second posts and the hand rail member can be separated from one another, said stair further comprising a fifth cross member connected to and extending between said second legs, said fifth cross member defining a plurality of yielding mounting recesses to releasasbly engage and hold said first and second posts and said hand rail member in a stowed position against said stair.

12. The stair as recited in claim 1, further comprising a. a fourth intermediate inverted U-shaped member comprising two fourth legs having lower ends pivotally connected to the first legs at a fifth pivot axis positioned below said first pivot axis, and a sixth cross member connected to and extending between upper ends of the fourth legs, said fourth U-shaped member having a seventh stowed position where the fourth legs are positioned adjacent to, and parallel to, the first legs, and an eighth support position where the fourth legs extend from the fifth pivot axis upwardly from the first legs, said stair further comprising a third intermediate support platform having a rear edge portion pivotally mounted to and positioned between said first legs at a sixth pivot axis located between the upper and lower ends of the first legs, and being movable between a ninth stowed position, where the third intermediate platform extends downwardly from said sixth pivot axis, and a tenth horizontal support position where a front edge portion of the third platform is supported from the third inverted U-shaped member in its tenth support position, b. said third lower platform having third mounting member means connected thereto and defining third elongate slot means having a substantial lengthwise alignment component generally parallel to a plane occupied by said third platform, said sixth cross member of said fourth inverted U-shaped member being positioned in said third slot means in a manner to be movable from a rear end of said third slot means, at which said sixth cross member is positioned when the third lower platform is in its ninth stowed position, to a second forward end of said third slot means at which said sixth cross member is positioned when the third platform is in its horizontal support position, c. said stair being further characterized in that a first distance between a portion of said sixth cross member located in said third slot means to said fifth pivot axis is less than a distance between said fifth pivot axis and said sixth pivot axis, whereby when said third platform moves from said tenth support position to said ninth stowed position, said third platform rotates about said sixth pivot axis downwardly toward said fifth pivot axis, d. said stair being further characterized in that with fourth U-shaped member in said eighth support position, said third legs have as substantial vertical alignment component greater than any horizontal alignment component of the fourth legs, whereby said fourth legs are positioned to effectively carry compresion loading from said second platform.

13. The stair as recited in claim 1, wherein with said first and second U-shaped members in said operating position, said first legs make a first angle with a support plane that is defined by the first lower support ends of the first legs and the second lower support ends of the second legs, and said second legs make a second angle with said support plane, said first angle being less than said second angle.

14. The stair as recited in claim 13, wherein said first angle is between about 35° to 55°, and said second angle is between about 55° to 75° degrees.

15. The stair as recited in claim 14, wherein said first angle is about 45°, and said second angle is about 65°.

16. A collapsible stair comprising:

a. a first inverted U-shaped supporot member comprising two laterally spaced first legs, each having a first lower support end and a first upper end, and a first cross member interconnecting the first upper ends;

b. a second inverted U-shaped support member having two second legs, each having a second lower support end and a second upper end, and a second cross member interconnecting the second upper ends of the second legs, said first and second legs being pivotally connected to one another at a first pivot axis located between the upper and lower ends of the first and second legs;

c. said first and second U-shaped members having a collapsed position where each of said first legs is adjacent to, and generally parallel to, an adjacent one of said second legs, and an operating position where the first legs are crossed with the second legs at an angle, with the first and second cross members being spaced from one another and lying in a common generally horizontal plane, and the lower first ends being positioned forwardly of the lower second ends;

d. a first upper support plaform having a rear edge portion hinge connected to said first cross member at a second pivot axis, and being movable between a first stowed position, where the upper platform extends downwardly from the first cross member so as to be adjacent to, and generally parallel to, said first legs, and a second horizontal support position where a forward edge portion of the first platform is supported by said second cross member;

e. a third inverted U-shaped member comprising two third legs having lower ends pivotally connected to the first legs at a third pivot axis positioned below said first pivot axis, and a third cross member connected to and extending between upper ends of the third legs, said third U-shaped member having a third stowed position where the third legs are positioned adjacent to, and parallel to, the first legs, and a fourth support position where the third legs extend from the third pivot axis upwardly and forwardly away from the first legs; and f. A second lower support platform having a rear edge portion piviotally mounted to and positioned between said first legs at a fourth pivot axis located between the upper and lower ends of the first legs, and being movable between a fifth stowed position, where the lower platform extends downwardly from said fourth pivot axis so as to be adjacent to, and parallel to, said first legs, and a sixth horizontal support position where a front edge portion of the second platform is supported from said third inverted U-shaped member in its support position, g. said stair further comprising a hand rail assembly comprising first and second posts having respective upper and lower ends, and a hand rail member having first and second end portions interconnecting with the upper ends of said first and second posts, respectively, each of said first and second posts having at their respective lower ends a laterally extending mounting member adapted to fit removably into a related receiving recess in said stair, whereby said first and second posts can be removably mounted to said stair;

h. said first cross member having one end thereof defining said recess for the laterally extending mounting member of the first post, said stair further comprising a fourth cross member connected to and extending between said first legs at said fourth pivot axis, said third cross member having an open end portion defining the recess to receive the laterally extending mounting member of the second post; and i. said first and second posts and said hand rail member being releasably connected to one another, whereby the first and second posts and the hand rail member can be separated from one another, said stair further comprising a fifth cross member connected to and extending between said second legs, said fifth cross member defining a plurality of yielding mounting recesses to releasably engage and hold said first and second posts and said hand rail member in a stowed position against said stair.

17. A collapsible stair comprising:

a. first inverted U-shaped support member comprising two laterally spaced first legs, each having a first lower support end and a first upper end, and a first cross member interconnecting the first upper ends;

b. a second inverted U-shaped support member having two second legs, each having a second lower support end and a second upper end, and a second cross member interconnecting the second upper ends of the second legs, said first and second legs being pivotally connected to one another at a first pivot axis located between the upper and lower ends of the first and second legs;

c. said first and second U-shaped members having a collapsed position where each of said first legs is adjacent to, and generally parallel to, an adjacent one of said second legs, and an operating position where the first legs are crossed with the second legs at an angle, with the first and second cross members being spaced from one another and lying in a common generally horizontal plane, and the lower first ends being positioned forwardly of the lower second ends;

d. a first upper support platform having a rear edge portion hinge connected to said first cross member at a second pivot axis, and being movable between a first stowed position, where the upper platform extends downwardly from the first cross member so as to be adjacent to, and generally parallel to, said first legs, and a second horizontal support position where a forward edge portion of the first platform is supported by said second cross member;

e. a third inverted U-shaped member comprising two third legs having lower ends pivotally connected to the first legs at a third pivot axis positioned below said first pivot axis, and a third cross member connected to and extending between upper ends of the third legs, said third U-shaped member having a third stowed position where the third legs are positioned adjacent to, and parallel to, the first legs, and a fourth support position where the third legs extend from the third pivot axis upwardly and forwardly away from the first legs;

f. a second lower support platform having a rear edge portion pivotally mounted to and positioned between said first legs at a fourth pivot axis located between the upper and lower ends of the first legs, and being movable between a fifth stowed position, where the lower platform extends downwardly from said fourth pivot axis so as to be adjacent to, and parallel to, said first legs, and a sixth horizontal support position where a front edge portion of the second platform is supported from said third inverted U-shaped member in its support position, g. said stair further comprising a hand rail assembly comprising first and second posts having respective upper and lower ends, and a hand rail member having first and second end portions interconnecting with the upper ends of the first and second posts, respectively, each of said first and second posts having at their respective lower ends mounting means by which said first and second posts can be mounted to said stair, said first and second posts and said hand rail member being releasably connected to one another, whereby the first and second posts and the handrail member can be separated from one another, said stair further comprising a fourth cross member connected to and extending between said second legs, said fourth cross member defining a plurality of yielding mounting recesses to releasably engage and hold said first and second posts and said hand rail member in a stowed position against said stair.

* * * * *